US006140283A

United States Patent [19]

Koganei

[11] Patent Number: 6,140,283

[45] Date of Patent: Oct. 31, 2000

[54] LUBRICANT OIL COMPOSITION FOR INTERNAL COMBUSTION ENGINES

[75] Inventor: Katsuya Koganei, Ohi-machi, Japan

[73] Assignee: Tonen Corporation, Saitama, Japan

[21] Appl. No.: 09/436,095

[22] Filed: Nov. 8, 1999

[30] Foreign Application Priority Data

Nov. 9, 1998 [JP] Japan ..... 10-317096

[51] Int. Cl.[7] ..... C10M 143/00; C10M 171/00

[52] U.S. Cl. ..... 508/591; 508/110; 208/18; 208/19; 585/1

[58] Field of Search ..... 508/591, 110; 585/1; 208/18, 19

[56] References Cited

U.S. PATENT DOCUMENTS

| | | | |
|---|---|---|---|
| 5,789,355 | 8/1998 | Adams et al. | 508/241 |
| 5,858,932 | 1/1999 | Dasai et al. | 508/591 |
| 5,942,475 | 8/1999 | Schlosberg et al. | 508/492 |

*Primary Examiner*—Jerry D. Johnson
*Attorney, Agent, or Firm*—Joseph J. Allocca

[57] ABSTRACT

This invention provides a lubricant oil composition for internal combustion engines which shows a sufficiently low volatility at high temperature and good low-temperature viscosity characteristics.

The lubricant oil composition for internal combustion engines comprises a base oil which simultaneously satisfies the following relationships ($a_1$) and ($b_1$):

$$[(A \cdot GCD5\text{-}50+B)\mathrm{Exp}((C \cdot GCD5\text{-}50+D)KV100)]/KV40>1, \text{ and} \quad (a_1)$$

$$E \cdot \mathrm{Exp}(F \cdot KV100)/KV40>1, \quad (b_1)$$

wherein, GCD5-50 is a difference between 5% and 50% distillation points (° C.) by gas chromatographic distillation test, KV40 and KV100 are kinematic viscosities ($mm^2/s$) at 40° C. and 100° C., and A to F are constants, A: $-3.17\times10^{-3}$, B: 2.87, C: $-3.78\times10^{4}$, D: $4.91\times10^{-1}$, E: 9.41, and F: $2.09\times10^{-1}$.

9 Claims, No Drawings

LUBRICANT OIL COMPOSITION FOR INTERNAL COMBUSTION ENGINES

BACKGROUND OF THE INVENTION

1. Field of the Invention

This invention relates to a lubricant oil composition for internal combustion engines, more particularly the composition is excellent in vaporization characteristics at high temperature and viscosity characteristics at low temperature.

2. Prior Art

Lubricant oils have been used for internal combustion engines, mainly for mechanical parts under lubricated conditions in engines, e.g., piston rings, cylinder liners, bearings for crank shafts and connecting rods, dynamic valve mechanisms including cams and valve lifters. In addition to the lubricating purposes above described, they are also used for cooling engines, cleaning and dispersing combustion products, and preventing rust and corrosion.

Therefore, lubricant oils for internal combustion engines are required to have a variety of performances, e.g., antiwear, heat resistance, dispersancy, volatility and fuel economy characteristics. These requirements are becoming even more severe, as the engines become more functional, produce higher power and are operated under severer conditions. In order to satisfy these requirements, lubricant base oils for internal combustion engines are incorporated with a variety of additives, such as ashless dispersant, metallic detergent, antiwear agent, fiction modifier and antioxidant.

In particular, lubricants for automobiles are required to extend oil drain interval (extended intervals between oil exchanges, or longer serviceability). On one hand, control of oil consumption has become one of the key issues, mainly because internal combustion engines are operated at higher speeds and produce higher power. It is therefore necessary to further reduce evaporation loss of a lubricant. On the other hand, a lubricant has a wider viscosity range to secure better fuel-saving characteristics. As a result, it is required to have better viscosity characteristics at low temperature.

Therefore, lubricants for internal combustion engines (e.g., gasoline and diesel engines) are increasingly required to be more serviceable (i.e., less volatile) and to have better viscosity characteristics at low temperature. These properties are believed to run counter to each other.

A variety of attempts have been made to improve resistance to heat and serviceability of lubricants for internal combustion engines by improving base oils. These base oils include a mineral base oil having a viscosity index of 80 or more, basic nitrogen content of 5 ppm or less and aromatic content of 1% or less, developed for lubricant compositions serviceable in a nitrogen oxide atmosphere (Japanese Patent No. 2,564,556); a mineral oil or others having a viscosity of 2 to 50 cSt at 100° C. and aromatic content of 2% or less, developed for lubricant compositions serviceable in a gaseous nitrogen oxide atmosphere for internal combustion engines (Japanese Patent Publication No. 6-62988); and a mineral oil having a total aromatic content of 2 to 15 wt % and total isoparaffin and 1-ring naphthene content of 60 wt % or more in the saturated component, developed for lubricant compositions for internal combustion engines (Japanese Patent No. 2,724,508).

On the other hand, the lubricant compositions developed to have improved low-temperature viscosity characteristics for internal combustion engines include a composition comprising a base oil having a pour point of −25° C. or less incorporated with specific additives (e.g., viscosity index improver) to improve temperature characteristics (Japanese Laid-open Patent Application No. 63-280796); and a composition comprising a base oil of low-viscosity oil and high-viscosity oil having a pour point of −25° C. or less (Japanese Patent Publication No. 8-13982).

In spite of these developments, however, few lubricant oil compositions show sufficient low volatility and low-temperature viscosity characteristics.

It would be an advance, therefore, to find or develop a new lubricant oil composition for internal combustion engines, which is low in volatility at high temperature and good in viscosity characteristics at low temperature, to solve problems involved in the conventional lubricant compositions.

The present invention is a lubricant oil composition comprising a base oil which satisfies specific properties or indices shows low volatility at high temperature and good viscosity characteristics at low temperature, reaching the present invention.

The present invention provides a lubricant oil composition for internal combustion engines, comprising a base oil which simultaneously satisfies the following relationships ($a_1$) and ($b_1$):

$$[(A \cdot GCD5\text{-}50+B)\mathrm{Exp}((C \cdot GCD5\text{-}50+D)KV100)]/KV40>1, \text{ and} \quad (a_1)$$

$$E \cdot \mathrm{Exp}(F \cdot KV100)/KV40>1, \quad (b_1)$$

wherein, GCD5-50 is a difference between 5% and 50% distillation points (° C.) by gas chromatographic distillation test, KV40 and KV100 are kinematic viscosities ($mm^2/s$) at 40 and 100° C., and A to F are constants, A: $-3.17\times10^{-3}$, B: 2.87, C: $-3.78\times10^{4}$, D: $4.91\times10^{-1}$, E: 9.41, and F: $2.09\times10^{-1}$.

The present invention also provides a lubricant oil composition for internal combustion engines, comprising a base oil as defined above which further satisfies the following relationship ($a_2$) or ($b_2$):

$$[(A \cdot GCD5\text{-}50+B)\mathrm{Exp}((C \cdot GCD5\text{-}50+D)KV100)]/KV40> 1.12, \text{ and} \quad (a_2)$$

$$E \cdot \mathrm{Exp}(F \cdot KV100)/KV40>1.18, \quad (b_2)$$

wherein the above notes are the same as those for the relationship ($a_1$) or ($b_1$).

The present invention also provides a lubricant oil composition for internal combustion engines, comprising a base oil as defined above which further satisfies either or both of the following relationship s ($a_3$) or ($b_3$):

$$[(A \cdot GCD5\text{-}50+B)\mathrm{Exp}((C \cdot GCD5\text{-}50+D)KV100)]/KV40> 1.09, \text{ and} \quad (a_3)$$

$$E \cdot \mathrm{Exp}(F \cdot KV100)/KV40>1.13, \quad (b_3)$$

wherein the above notes are the same as those for the relationship ($a_1$) or ($b_1$).

The present invention provides, as described above, a lubricant oil composition for internal combustion engines, comprising a base oil which satisfies the relationships regarding (a) and (b), and the preferred embodiments include the following compositions:

(1) A lubricant oil composition for internal combustion engines, comprising a base oil as defined above which satisfies the relationships ($a_1$) and ($b_1$), and, at the same time, further satisfies either or both of the following relationship ($a_4$) or ($b_4$):

$$[(A \cdot GCD5\text{-}50+B)\mathrm{Exp}((C \cdot GCD5\text{-}50+D)KV100)]/KV40> 1.04, \text{ and} \quad (a_4)$$

$$E \cdot \mathrm{Exp}(F \cdot KV100)/KV40>1.11, \quad (b_4)$$

wherein the above notes are the same as those for the relationship ($a_1$) or ($b_1$).

(2) A lubricant oil composition for internal combustion engines, comprising a base oil which satisfies the relationships (a) and (b), and, at the same time, is incorporated with an ethylene-α-olefin copolymer having a weight-average molecular weight of 150,000 to 300,000 and an ethylene ratio of 50 to 75 mol % in the copolymer.

(3) A lubricant oil composition for internal combustion engines of one of the above whose base oil is a mineral or synthetic oil of high viscosity index.

(4) A lubricant oil composition for internal combustion engines of one of the above whose base oil has a kinematic viscosity of 4.2 to 5.5 $mm^2/s$ (determined by ASTM D445 or JIS K2283) at 100° C.

(5) A lubricant oil composition for internal combustion engines of one of the above whose base oil has a GCD5-50 value (difference between 5% and 50% distillation points (° C.) by gas chromatographic distillation test) of 40 to 70° C.

(6) A lubricant oil composition for internal combustion engines of one of the above whose base oil has a pour point of −7.5° C. or less.

(7) A lubricant oil composition for internal combustion engines of one of the above which satisfies the new engine oil specifications (ILSAC GF-3).

(8) A lubricant oil composition for internal combustion engines of one of the above whose base oil is incorporated with at least one additive selected from the group consisting of ashless dispersant, metallic detergent, antiwear agent, friction reducing agent, antioxidant, pour point depressant, rust inhibitor, corrosion inhibitor, antifoamant, and others required for a lubricant oil composition for internal combustion engines.

The present invention is described concretely, below.

(1) Lubricant Base Oil

The base oil for the lubricant oil composition of the present invention contains, as the essential component a base oil which simultaneously satisfies the following relationships ($a_1$) and ($b_1$):

$$[(A \cdot GCD5\text{-}50+B)\mathrm{Exp}((C \cdot GCD5\text{-}50+D)KV100)]/KV40>1, \text{ and} \quad (a_1)$$

$$E \cdot \mathrm{Exp}(F \cdot KV100)/KV40>1, \quad (b_1)$$

wherein GCD5-50 is a difference between 5% and 50% distillation points (° C.) by gas chromatographic distillation test, KV40 and KV100 are kinematic viscosities ($mm^2/s$) at 40° C. and 100° C., and A to F are constants, A: $-3.17\times10^{-3}$, B: 2.87, C: $-3.78\times10^{4}$, D: $4.91\times10^{-1}$, E: 9.41, and F: $2.09\times10^{-1}$.

Volatility of lubricant oils is generally determined by NOACK evaporation test (DIN 51581) or gas chromatographic distillation test (ASTM D2887). Gas chromatographic distillation test, although simple, is originally developed to evaluate distillation properties of base oil or the like. NOACK evaporation test, on the other hand, measures weight loss of the sample (e.g., lubricant base oil) heated at 250° C. for 1 hour, by which its distillation properties are evaluated. It is considered that there is a fairly good correlation between evaporated quantity determined by NOACK test and oil consumption. NOACK evaporated quantity is described in the ILSAC GF-1 and GF-2 specifications jointly established by SAE and JAMA. In particular, the new specification for engine oils (ILSAC GF-3) planned to be effective in 2000 will specify NOACK evaporated quantity of 15 wt % or less as the evaporation property.

The left term of the relationship (al) represents an index of evaporation, simply derived from, e.g., difference (° C.) between 5% and 50% distillation points by gas chromatographic distillation test. The base oil which satisfies the relationship ($a_1$) will have good evaporation-related properties and a NOACK evaporated quantity of 15 wt % or less.

The left term of the relationship ($b_1$) represents an index of viscosity at low temperature, simply derived from kinematic viscosities ($mm^2/s$) at 40° C. and 100° C. The base oil which satisfies the relationship ($b_1$) will have good viscosity-related properties at low temperature, i.e., CCS viscosity of 3.5 Pa•S (3,500 cP) or less at −25° C.

A lubricant oil composition will have good properties with respect to evaporation (NOACK evaporated quantity) and viscosity at low temperature (CCS viscosity at −25° C.), when its base oil simultaneously satisfies the relationships ($a_1$) and ($b_1$). The index of evaporation ($a_1$) is preferably above 1 and below 1.12, more preferably above 1 and below 1.09, and most preferably above 1 and below 1.04. The index of viscosity ($b_1$) is preferably above 1 and below 1.18, more preferably above 1 and below 1. 13, and most preferably above 1 and below 1.11. The lubricant oil composition comprising the above base oil will simultaneously satisfy the evaporation and low-temperature viscosity characteristics, which tend to run counter to each other.

The base oil for the present invention is not limited. It may be a mineral or synthetic oil, or a mixture thereof, so long as it simultaneously satisfies the relationships ($a_1$) and ($b_1$).

The mineral oils useful for the present invention include lubricant stocks, obtained by atmospheric or vacuum distillation of crude, e.g., raffinate from solvent extraction with an aromatic extracting solvent such as phenol, furfural and N-methyl pyrrolidone; hydrotreated oil obtained by treating stocks with hydrogen under hydrotreatment conditions in the presence of a hydrotreatment catalyst; hydrocrackate obtained by treating stocks with hydrogen under severer hydrocracking conditions; isomerate obtained by isomerizing stocks with hydrogen under isomerization conditions in the presence of an isomerization catalyst; and those stocks obtained by a combination of solvent refining, hydrotreatment, hydrocracking or isomerization. In particular, mineral oils of high viscosity index, obtained by hydrocracking or hydroisomerization, is suitable for the present invention. Any process described above can be optionally combined with dewaxing, hydrofinishing, clay treatment or the like operated in a normal manner. More specifically, the mineral base oils useful for the present invention include light, medium and heavy neutral oils, and bright stocks. These base oils can be mixed with one another, to satisfy the requirements of the present invention.

The examples of synthetic base oils include a poly-α-olefin α-olefin oligomer, polybutene, alkylbenzene, polyol ester, dibasic acid ester, polyoxyalkylene glycol, polyoxyalkylene glycol ether, and silicone oil.

These base oils may be used individually or in combination. A mineral oil may be combined with a synthetic oil. Particularly preferable ones include oils containing aromatics at 3 wt % or less, sulfur at 50 weight ppm or less and nitrogen at 50 weight ppm or less, e.g., hydrotreated oil, hydrocrackate, isomerized wax and a mineral oil having a high viscosity index of at least 120, which are used individually; and mixtures of a poly-α-olefin and polyol ester or dibasic acid ester, and a mineral oil having a high viscosity index and polyol ester or dibasic acid ester.

The base oil for the present invention generally has a kinematic viscosity of 2 to 20 mm2/s at 100° C., preferably 3 to 15 mm2/s, more preferably 4.2 to 5.5 mm2/s. Deteriorated viscosity at low temperature and increased friction loss may result when it exceeds the above range, and increased wear at mechanical parts in engines (e.g., piston rings and valve trains) may result when it is below the above range.

The base oil for the present invention preferably has a GCD5-50 value (difference between 5% and 50% distillation points (° C.) by gas chromatographic distillation test) of 40 to 70° C. Deteriorated evaporation characteristics may result when it exceeds 70° C., and NOACK evaporated quantity of the base oil may be little improved when it is below 40° C. The base oil for the present invention also preferably has a pour point of −7.5° C. or less, more preferably −15° C. or less. Deteriorated viscosity at low temperature may result, when it exceeds −7.5° C.

(2) Additive Components

As described above, the lubricant oil composition of the present invention for internal combustion engines comprises a base oil which simultaneously satisfies the above relationships (a) and (b). The preferred embodiments of the present invention include those comprising a base oil incorporated with a viscosity index improver of ethylene-α-olefin copolymer having a weight-average molecular weight of 150,000 to 300,000 and an ethylene ratio of 50 to 75 mol % in the copolymer (e.g., ethylene-propylene copolymer). Deteriorated viscosity at low temperature may result when its weight-average molecular weight is below 150,000 whereas deteriorated shear stability may result when it exceeds 300,000. Deteriorated viscosity at low temperature may result when its ethylene ratio is below 50 mol %, whereas gelation may occur when it is above 75 mol %. the ethylene-α-olefin copolymer is incorporated normally at 0.1 to 1.5 wt % based on the whole lubricant oil composition. It may be diluted before use.

The base oil for the present invention may be further incorporated with one or more types of additives normally used for lubricant oils for internal combustion engines, so long as the object of the present invention is not damaged. These additives include ashless dispersant, metallic detergent, antiwear agent, friction reducing agent, antioxidant, pour point depressant, metal deactivator, rust inhibitor, corrosion inhibitor and antifoamant.

The ashless dispersants useful for the present invention include those based on polyalkenyl succinimide, polyalkenyl succinamide, benzyl amine, succinic acid ester, and succinic acid-amide, and those containing boron. Of these, polyalkenyl succinimide (polybutenyl succinimide)-based ones which may be treated with boron are preferably used. If one is used, it is incorporated normally at 0.1 to 10 wt %.

The metallic detergents useful for the present invention include those based on sulfonate of Ca, Mg, Ba or the like, phenate, salicylate and phosphonate. If one is used, it is incorporated normally at 0.05 to 5 wt %.

The antiwear agents useful for the present invention include metallic (e.g., Zn, Pb, Sb and Mo) salts of dithiophosphate, metallic (e.g., Mo, Pb and Sb) salts of dithiocarbamic acid, metallic (e.g., Pb) salts of naphthenic acid, metallic (e.g., Pb) salts of fatty acids, sulfur compounds, boron compounds, phosphate esters, phosphite esters, phosphate ester amines and phosphite ester amines. Of these, phosphate esters and metallic salts of dithiophosphate are preferably used. If one is used, it is incorporated normally at 0.05 to 5 wt %.

The friction reducing agents useful for the present invention include an organomolybdenum compound, fatty acid, higher alcohol, fatty acid ester, oil and fat, polyalcohol (partial) ester, sorbitan ester, amine, amide, sulfided ester, phosphate ester, phosphite ester and phosphate ester amine. Of these, an organomolybdenum compound, in particular sulfur-free molybdenum phosphate or molybdenum amine complex, is preferably used. If one is used, it is incorporated normally at 0.05 to 3 wt %.

The antioxidants useful for the present invention generally include amine-based ones, e.g., alkylated diphenyl amine, phenyl-α-naphthyl amine and alkylated phenyl-α-naphthyl amine; phenol-based ones, e.g., 2,6-ditertiary butyl phenol and 4,4'-methylene bis-(2,6-6-ditertiary butyl phenol); sulfur-based ones, e.g., dilauryl-3,3'-thiodipropionate; phosphorus-based ones, e.g., phosphite and zinc dithiophosphate. Of these, amine- and phenol-based ones are preferably used. If one is used, it is incorporated normally at 0.05 to 5 wt %.

The pour point depressants useful for the present invention generally include an ethylene-vinyl acetate copolymer, condensate of chlorinated paraffin and naphthalene, condensate of chlorinated paraffin and phenol, polymethacrylate, and polyalkyl styrene. Of these, a polymethacrylate is preferably used. If one is used, it is incorporated normally at 0.01 to 5 wt %.

The metal deactivators useful for the present invention include benzotriazole, and derivatives of triazole, benzotriazole and thiadiazole. If one is used, it is incorporated normally at 0.001 to 3 wt %.

The rust inhibitors useful for the present invention include a fatty acid, alkenyl succinic acid half ester, fatty acid soap, alkyl sulfonate, ester of fatty acid and polyalcohol, fatty acid amine, oxidized paraffin and alkyl polyoxyethylene ether. If one is used, it is incorporated normally at 0.01 to 3 wt %.

The lubricant oil composition of the present invention for internal combustion engine may be further incorporated with one or more types of other additives, e.g., corrosion inhibitor, antifoamant and coloring agent, as required.

EXAMPLES AND COMPARATIVE EXAMPLES

The present invention is described below in detail by Examples and Comparative Examples, which by no means limit the present invention. Gas chromatographic distillation, and measurement of evaporation characteristics and viscosity at low temperature were conducted by the following procedures for Examples and Comparative Examples:

(1) Gas Chromatographic Distillation Test

The gas chromatographic distillation test was conducted in accordance with ASTM D2887, by which difference between 5% and 50% distillation point (° C.) (GCD5-50) was determined. The apparatus was HP 5890 series II GC Simulated Distillation, and the following conditions were used:

Column: HP-1, Length: 30 m, Diameter: 0.53 mm, Film Thickness: 0.88 μ, HP Part No.: 19095Z-23
Initial Temperature: 35° C.
Heating Rate: 10° C./minute
Final Temperature: 350° C.
Holding Time: 10 minutes
Carrier Gas: He (10 mL/minute)

(2) Evaluation of Evaporation Characteristics

Evaporation characteristics of the lubricant oil was evaluated by NOACK test to determine the evaporated quantity, which is evaporation loss of the sample heated at 250° C. and −20 mm$H_2O$ for 1 hour in accordance with DIN 51581 (CEC L-40-A93), as mentioned earlier. The development target was set at a NOACK evaporated quantity of 15 wt % or less, which is considered to be a criterion to give good evaporation characteristics.

(3) Evaluation of Viscosity at Low Temperature

Viscosity of the lubricant oil at low temperature was evaluated by CCS viscosity at −25° C., measured by ASTM D5293 (or JIS K2010). The development target was set at a viscosity of 3.5 Pa•S (3,500 cP) or lower at −25° C. (SAE viscosity grade 5W).

Examples 1 to 8

The base oils used for Examples 1 to 8 are shown in Table 1. Each of these base oils was incorporated with those conventional additives at given quantities based on the whole composition, normally needed to prepare a formulated lubricant oil composition. Each composition was tested for its evaporation and low-temperature viscosity characteristics. The results are given in Table 1. As shown, each composition has good evaporation and low-temperature viscosity characteristics.

TABLE 1

| | Example 1 | Example 2 | Example 3 | Example 4 | Example 5 | Example 6 | Example 7 | Example 8 |
|---|---|---|---|---|---|---|---|---|
| Base oil properties | | | | | | | | |
| • Kinematic viscosity at 40° C. (KV40), $mm^2/s$ | 20.11 | 21.37 | 20.15 | 22.21 | 21.25 | 22.84 | 21.86 | 22.34 |
| • Kinematic viscosity at 100° C. (KV100), $mm^2/s$ | 4.453 | 4.651 | 4.395 | 4.695 | 4.442 | 4.752 | 4.480 | 4.598 |
| • GCD-50① ° C. | 45 | 50 | 41 | 58 | 50 | 74 | 56 | 59 |
| • Value of relationship (a): index of evaporation② | 1.119 | 1.140 | 1.099 | 1.094 | 1.039 | 1.042 | 1.011 | 1.036 |
| • Value of relationship (b): index of viscosity at low temperature③ | 1.187 | 1.164 | 1.170 | 1.130 | 1.121 | 1.112 | 1.098 | 1.101 |
| Additive package for GF-3④ | Added | Added | Added | Added | Added | Added | Added | Added |
| Lubricant oil composition properties | | | | | | | | |
| • NOACK evaporated quantity, wt % | 9.9 | 9.5 | 10.4 | 11.1 | 12.9 | 13.2 | 14.1 | 13.3 |
| • CCS viscosity at −25° C., Pa · S | 1.79 | 1.88 | 1.85 | 2.02 | 2.07 | 2.11 | 2.19 | 2.17 |

①Difference between 5% and 50% distillation points (° C.) by gas chromatographic distillation test
②[(A • GCD5-50 + B)Exp((C • GCD5-50 + D)KV100)])/KV40 A to D are constants; A: $-3.17 \times 10^{-3}$, B: 2.87, C: $-3.78 \times 10^{-4}$, and D: $4.91 \times 10^{-1}$.
③E • Exp (F • KV100)/KV40 E and F are constants; E: 9.41 and F: $2.09 \times 10^{-1}$
④An additive package for new engine oil specification (ILSAC GF-3); including a viscosity index improver, pour point depressant and antifoamant. The viscosity index improver used was ethylene-α-olefin copolymer having a weight-average molecular weigh of 160,000 and an ethylene/propylene molar ratio of 71/29.

Comparative Examples 1 to 4

The base oils used for Comparative Examples 1 to 4 are shown in Table 2. Each of these base oils was incorporated with conventional additives at given quantities based on the whole composition normally needed to prepare a formulated lubricant oil composition in a manner similar to those for Examples. Each composition was tested for its evaporation and low-temperature viscosity characteristics. The results are given in Table 2.

TABLE 2

| | Comparative Example 1 | Comparative Example 2 | Comparative Example 3 | Comparative Example 4 |
|---|---|---|---|---|
| Base oil properties | | | | |
| Kinematic viscosity at 40° C. (KV40), $mm^2/s$ | 20.52 | 25.54 | 29.45 | 20.26 |
| Kinematic viscosity at 100° C. (KV100), $mm^2/s$ | 4.179 | 4.770 | 5.266 | 4.354 |
| GCD-50[1] ° C. | 80 | 74 | 53 | 74 |
| Value of relationship (a): index of evaporation[2] | 0.875 | 0.939 | 1.096 | 0.977 |
| Value of relationship (b): index of viscosity at low temperature[3] | 1.098 | 0.998 | 0.960 | 1.154 |
| Additive package for GF-3[4] | Added | Added | Added | Added |
| Lubricant oil composition properties | | | | |
| NOACK evaporated quantity, wt % | 21.8 | 16.1 | 12.7 | 15.9 |
| CCS viscosity at −25° C., Pa · S | 2.62 | 3.53 | 4.71 | 1.96 |

[1]Difference between 5% and 50% distillation points (° C.) by gas chromatographic distillation test
[2][(A · GCD5-50 + B)Exp((C · GCD5-50 + D)KV100)]/KV40 A to D are constants; A: $-3.17 \times 10^{-3}$, B: 2.87, C: $-3.78 \times 10^{-4}$, and D: $4.91 \times 10^{-1}$.
[3]E · Exp (F · KV100)/KV40 E and F are constants; E: 9.41 and F: $2.09 \times 10^{-1}$.
[4]An additive package for new engine oil specification (ILSAC GF-3); including a viscosity index improver, pour point depressant and antifoamant. The viscosity index improver used was ethylene-α-olefin copolymer having a weight-average molecular weigh of 160,000 and an ethylene/propylene molar ratio of 71/29.

It is apparent, by comparing the Example results with the Comparative Example results, that the lubricant oil composition prepared by each of Examples shows high qualities, i.e., low NOACK evaporated quantity and low viscosity at low temperature, as its base oil satisfies the relationships ($a_1$) and ($b_1$) representing indices of evaporation and viscosity at low temperature. Taking the results of Example 1 as an example, the lubricant oil composition comprising the base oil which satisfies the relationships ($a_1$) and ($b_1$) (i.e., index of evaporation of 1.119 and index of low-temperature viscosity of 1.187) has a NOACK evaporated quantity of 9.9 wt % and CCS viscosity of 1.79 Pa•S at −25° C., attaining the development targets. Each of the compositions prepared by other Examples similarly shows high lubricant oil qualities.

On the other hand, each of the lubricant compositions prepared by Comparative Examples 1 to 4 comprised a base oil which failed to satisfy the relationship ($a_1$) or ($b_1$) representing index of evaporation or viscosity at low temperature. Such a composition attained neither target of NOACK evaporated quantity nor that of CCS viscosity at −25° C.

These results indicate that a lubricant oil composition will have insufficient qualities with respect to evaporation and low-temperature viscosity characteristics, unless its base oil simultaneously satisfies the relationships ($a_1$) and ($b_1$) representing indices of evaporation and viscosity at low temperature. In other words, it is apparent that a lubricant oil composition will show a sufficiently low volatility at high temperature and good low-temperature viscosity characteristics for internal combustion engines, when its base oil simultaneously satisfies an index of evaporation represented by the relationship ($a_1$) and index of viscosity at low temperature represented by the relationship ($b_1$).

The lubricant oil composition of the present invention for internal combustion engines shows a sufficiently low volatility at high temperature and good low-temperature viscosity characteristics for internal combustion engines by using a base oil which simultaneously satisfies an index of evaporation represented by the relationship ($a_1$) and index of viscosity at low temperature represented by the relationship ($b_1$). It satisfies the new engine oil specification (ILSAC GF-3) and is particularly suitable as the lubricant oil for gasoline and diesel engines.

What is claimed is:

1. A lubricant oil composition for internal combustion engines, comprising a base oil which simultaneously satisfies the following relationships ($a_1$) and ($b_1$):

$$[(A \cdot GCD5\text{-}50+B)\mathrm{Exp}((C \cdot GCD5\text{-}50+D)KV100)]/KV40>1, \text{ and} \quad (a_1)$$

$$E \cdot \mathrm{Exp}(F \cdot KV100)/KV40>1, \quad (b_1)$$

wherein, GCD5-50 is a difference between 5% and 50% distillation points (° C.) by gas chromatographic distillation test, KV40 and KV100 are kinematic viscosities ($mm^2/s$) at 40° C. and 100° C., and A to F are constants, A: $-3.17\times10^{-3}$, B: 2.87, C: $-3.78\times10^{-1}$, D: $4.91\times10^{-1}$, E: 9.41, and F: $2.09\times10^{-1}$.

2. The lubricant oil composition for internal combustion engines of claim 1, wherein said base oil further satisfies either or both of the following relationship ($a_2$) or ($b_2$):

$$[(A \cdot GCD5\text{-}50+B)\mathrm{Exp}((C \cdot GCD5\text{-}50+D)KV100)]/KV40<1.12, \text{ and} \quad (a_2)$$

$$E \cdot \mathrm{Exp}(F \cdot KV100)/KV40<1.18 \quad (b_2).$$

3. The lubricant oil composition for internal combustion engines of claim 1, wherein said base oil further satisfies either or both the following relationship s ($a_3$) or ($b_3$):

$$[(A \cdot GCD5\text{-}50+B)\mathrm{Exp}((C \cdot GCD5\text{-}50+D)KV100)]/KV40<1.09, \text{ or } (a_3)$$

$$E \cdot \mathrm{Exp}\ (F \cdot KV100)/KV40<1.13 \quad (b_3).$$

4. The lubricating oil composition for internal combustion engines of claim 1, wherein said base oil further satisfies either or both of the following relationship ($a_4$) or ($b_4$):

$$[(A \cdot GCD5\text{-}50+B)\mathrm{Exp}((C \cdot GCD5\text{-}50+D)KV100)]/KV40<1.04 \quad (a_4)$$

$$E \cdot \mathrm{Exp}(F \cdot KV100)/KV40<1.11 \quad (b_4).$$

5. The lubricating oil composition for internal combustion engines of claim 1, 2, 3 or 4, wherein the base oil further is incorporated with an ethylene-α-olefin copolymer having a weight-average molecular weight of 150,000 to 300,000 and an ethylene ratio of 50 to 75 mol % in the copolymer.

6. The lubricating oil composition for internal combustion engines of claim 1, 2, 3 or 4, wherein the base oil is a mineral oil, a synthetic oil, or mixture thereof having a kinematic viscosity of 4.2 to 5.5 $mm^2/s$ (determined by ASTM D445 or JIS K2283) at 100° C.

7. The lubricating oil composition for internal combustion engines of claim 1, 2, 3 or 4, wherein the base oil has a GCD5-50 value of 40° C. to 70° C.

8. The lubricating oil composition for internal combustion engines of claim 1, 2, 3 or 4 wherein the base oil has a pour point of −7.5° C. or less.

9. The lubricating oil composition for internal combustion engines of claim 1, 2, 3 or 4 containing at least one additive selected from the group consisting of ashless dispersant, metallic detergent, antiwear additive, friction reducing agent, antioxidant, pour point depressant, rust inhibitor, corrosion inhibitor, antifoamant.

* * * * *